US010882341B2

(12) United States Patent
Ikagawa et al.

(10) Patent No.: US 10,882,341 B2
(45) Date of Patent: Jan. 5, 2021

(54) RECORDING APPARATUS

(71) Applicant: SEIKO EPSON CORPORATION, Tokyo (JP)

(72) Inventors: Takamasa Ikagawa, Matsumoto (JP); Yuichi Segawa, Shiojiri (JP); Akinori Muromachi, Matsumoto (JP); Yoshikazu Koike, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/453,144

(22) Filed: Jun. 26, 2019

(65) Prior Publication Data

US 2020/0001624 A1 Jan. 2, 2020

(30) Foreign Application Priority Data

Jun. 29, 2018 (JP) ..... 2018-124635

(51) Int. Cl.
*B41J 2/01* (2006.01)
*B41J 11/00* (2006.01)

(52) U.S. Cl.
CPC ..... *B41J 11/007* (2013.01); *B41J 11/0095* (2013.01); *B65H 2404/20* (2013.01)

(58) Field of Classification Search
None
See application file for complete search history.

(56) References Cited

U.S. PATENT DOCUMENTS

2006/0050124 A1 3/2006 Adachi
2007/0059020 A1 3/2007 Yoshikawa
2009/0052917 A1* 2/2009 Kogure ..... B41J 11/007 399/55

FOREIGN PATENT DOCUMENTS

EP 2184174 5/2010
EP 2341019 7/2011
JP 2006-027771 A 2/2006
JP 2007-079184 A 3/2007

OTHER PUBLICATIONS

European Search Report for EP 19182171 dated Nov. 4, 2019.

* cited by examiner

*Primary Examiner* — Erica S Lin
*Assistant Examiner* — Tracey M McMillion
(74) *Attorney, Agent, or Firm* — Workman Nydegger

(57) ABSTRACT

A recording apparatus includes a recording head that performs recording on a medium, a transport belt that has an clinging surface that cling the medium, and transports the medium to a position facing the recording head, a first charging unit that is in contact with the transport belt to frictionally charge the clinging surface, and a second charging unit that applies a voltage to the transport belt to charge the clinging surface, in which a control unit, which switches between charging of the clinging surface by the first charging unit and charging of the clinging surface by the second charging unit, switches between the charging of the clinging surface by the first charging unit and the charging of the clinging surface by the second charging unit, according to a state of a surface of the medium, which is in contact with the clinging surface.

20 Claims, 10 Drawing Sheets

RECORDING APPARATUS

The present application is based on, and claims priority from JP Application Serial Number 2018-124635, filed Jun. 29, 2018, the disclosure of which is hereby incorporated by reference herein in its entirety.

BACKGROUND

1. Technical Field

The present disclosure relates to a recording apparatus that performs recording on a medium.

2. Related Art

In a recording apparatus represented by a printer, a configuration may be adopted in which a medium represented by a recording paper sheet is transported using a transport belt. Further, in this configuration, the medium may be adsorbed to the transport belt by charging the transport belt (see JP-A-2006-27771).

Ozone may be generated while the transport belt is charged, and a filter may be provided to prevent leakage of the ozone to the outside of the apparatus, depending on the amount of generated ozone. However, in the related art, defect caused by the ozone inside the apparatus is not particularly considered, and for example, there is a possibility that a water-repellent film on a surface of the recording head is contaminated by the ozone, and ink ejection failure occurs. Further, since the transport belt is charged, there is a possibility that the ink is drawn from a nozzle of the recording head disposed to face the charged transport belt, the drawn ink is thickened, and thus ink ejection failure occurs.

SUMMARY

According to an aspect of the present disclosure, a recording apparatus includes a recording head that performs recording on a medium, a transport belt that has an clinging surface that cling the medium, and transports the medium to a position facing the recording head, a first charging unit that is in contact with the transport belt to frictionally charge the clinging surface, a second charging unit that applies a voltage to the transport belt to charge the clinging surface, and a control unit that controls the first charging unit and the second charging unit, in which the control unit switches between the charging of the clinging surface by the first charging unit and the charging of the clinging surface by the second charging unit, according to a state of a surface of the medium, which is in contact with the clinging surface.

DESCRIPTION OF EXEMPLARY EMBODIMENTS

Figure 1:
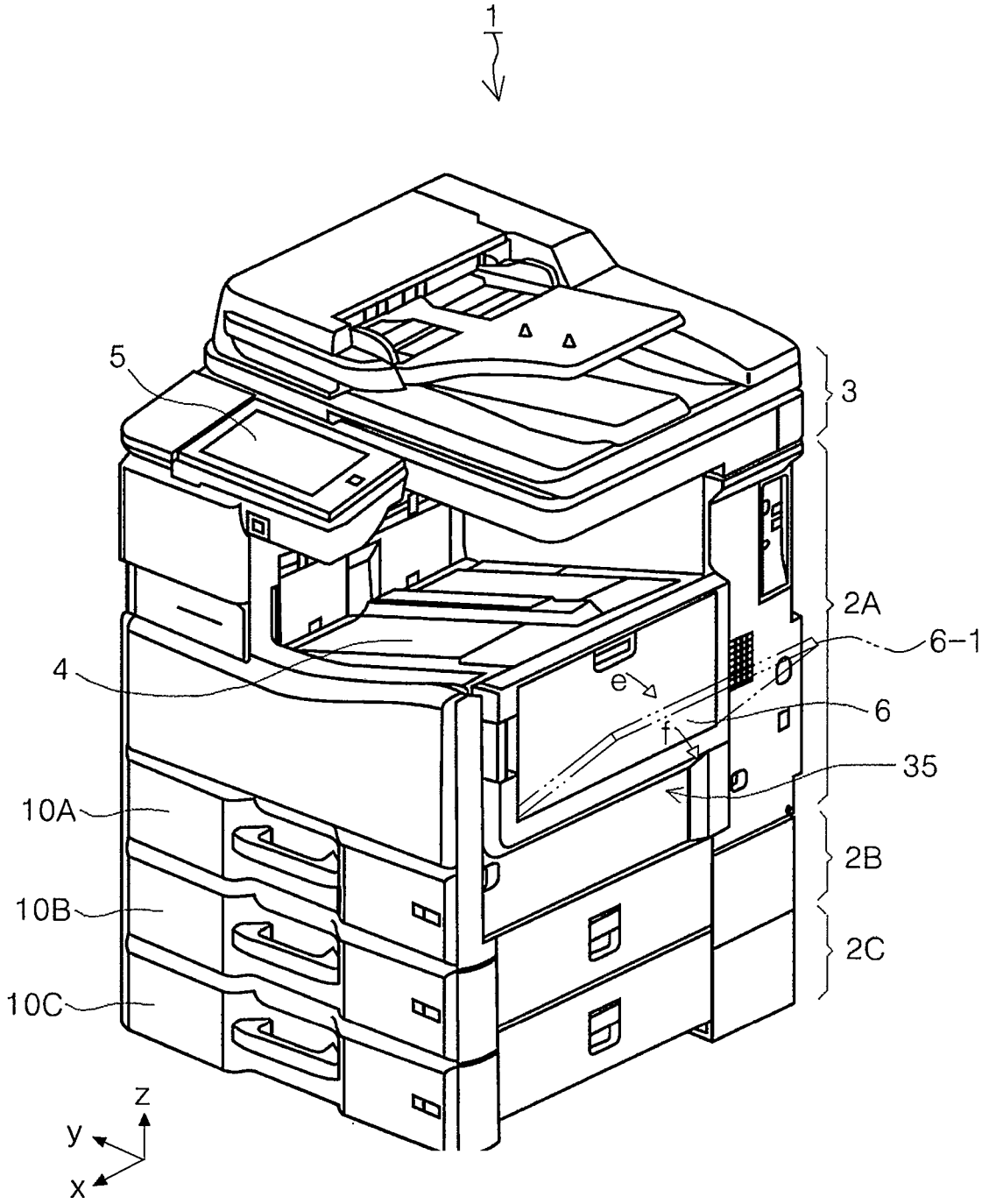
FIG. 1 is a perspective view illustrating an outer appearance of an ink jet printer according to the present disclosure.

Hereinafter, the present disclosure will be described schematically.

A recording apparatus according to a first aspect of the present disclosure includes a recording head that performs recording on a medium, a transport belt that has an clinging surface that cling the medium, and transports the medium to a position facing the recording head, a first charging unit that is in contact with the transport belt to frictionally charge the clinging surface, a second charging unit that applies a voltage to the transport belt to charge the clinging surface, and a control unit that switches between charging of the clinging surface by the first charging unit and charging of the clinging surface by the second charging unit, in which the control unit switches between the charging of the clinging surface by the first charging unit and the charging of the clinging surface by the second charging unit, according to a state of a surface of the medium, which is in contact with the clinging surface.

According to the present aspect, the recording apparatus includes the first charging unit that is in contact with the transport belt to frictionally charge the clinging surface that cling the medium, and the second charging unit that applies a voltage to the transport belt to charge the clinging surface. Since the control unit switches between the charging of the clinging surface by the first charging unit and the charging of the clinging surface by the second charging unit according to the state of the surface of the medium, which is in contact with the clinging surface, the charging of the clinging surface by the second charging unit is minimized, so that both suppression of the amount of generated ozone and proper clinging of the medium to the clinging surface are achieved. Further, as the first charging unit is selected, power consumption can be suppressed. Further, since the control unit switches between the charging of the clinging surface by the first charging unit and the charging of the clinging surface by the second charging unit according to the state of the surface of the medium, which is in contact with the clinging surface, according to the transport belt, a period during which the charging is performed by the second charging unit that performs stronger charging can be reduced, and an increase in viscosity of the ink caused by pulling out an ink from a nozzle of the recording head can be suppressed.

According to a second aspect of the present disclosure, in the first aspect, the control unit determines whether or not recording is performed on a surface adsorbed to the clinging surface as a state of the surface of the medium, selects the charging of the clinging surface by the first charging unit when the surface of the medium on which the recording is not performed is adsorbed to the clinging surface, and selects the charging of the clinging surface by the second charging unit when the surface of the medium on which the recording is already performed is adsorbed to the clinging surface.

In particular, when recording is performed by ejecting a liquid to the medium, on a surface of the medium to which the liquid is ejected, that is, the surface of the medium on which the recording is already performed, and a surface of the medium to which the liquid is not ejected, that is, the surface of the medium on which the recording is not performed, the latter, that is, the surface of the medium on which the recording is not performed, has low electric conductivity, and is adsorbed to the clinging surface well. According to the present aspect, since the control unit selects the charging of the clinging surface by the first charging unit when the surface of the medium on which the recording is not performed is adsorbed to the clinging surface, and selects the charging of the clinging surface by the second charging unit when the surface of the medium on which the recording is already performed is adsorbed to the clinging surface, both when the surface of the medium on which the recording is already performed is adsorbed and when the surface of the medium on which the recording is not performed is adsorbed, the medium can be properly adsorbed.

According to a third aspect, in the first to second aspects, the charging of the clinging surface by the second charging unit is configured to be switched between charging by application of a first voltage and charging by application of a second voltage that is less than the first voltage, and when the charging of the clinging surface by the second charging unit is selected, the control unit selects the first voltage in a contact area of the clinging surface, which is in contact with the medium, and selects the second voltage in a non-contact area of the clinging surface, which is not in contact with the medium.

According to the present aspect, when the second charging unit is selected, since the control unit selects the first voltage in the contact area of the clinging surface, which is in contact with the medium, and selects the second voltage that is lower than the first voltage in the non-contact area of the clinging surface, which is not in contact with the medium, the amount of generated ozone when the second charging unit is selected can be suppressed.

Further, in the present specification, the second voltage includes 0 V.

According to a fourth aspect of the present disclosure, in the first to second aspects, the charging of the clinging surface by the second charging unit is configured to be switched between charging by application of a first voltage and charging by application of a second voltage that is less than the first voltage, and when the charging of the clinging surface by the second charging unit is selected, the control unit selects the first voltage in an area of the clinging surface, where a leading end and a trailing end of the medium are in contact with each other and selects the second voltage in an area of the clinging surface, which is in contact with an intermediate portion between the leading end and the trailing end of the medium.

According to the present aspect, when the second charging unit is selected, the control unit selects the first voltage in the area of the clinging surface where the leading end and the trailing end of the medium are in contact with each other, and selects the second voltage that is lower than the first voltage in the area of the clinging surface, which is in contact with the intermediate portion between the leading end and the trailing end of the medium, floating from the clinging surface can be satisfactorily suppressed by selecting the first voltage in the leading end and the trailing end of the medium, and the amount of the generated ozone can be suppressed by selecting the second voltage in the area which is in contact with the intermediate portion between the leading end and the trailing end of the medium.

Further, in the present specification, the second voltage includes 0 V.

According to a fifth aspect of the present disclosure, in the first aspect, the control unit determines a recording density of a surface adsorbed to the clinging surface as a state of the surface of the medium, and switches between the first charging unit and the second charging unit according to the recording density of the surface of the medium, which is in contact with the clinging surface.

According to a sixth aspect, in the first aspect, the control unit selects the charging of the clinging surface by the first charging unit when the recording density of the surface of the medium, which is in contact with the clinging surface, is low, and selects the charging of the clinging surface by the second charging unit when the recording density of the surface of the medium, which is in contact with the clinging surface, is high.

According to the present aspect, since the control unit switches between the first charging unit and the second charging unit according to the recording density of the surface of the medium, which is in contact with the clinging surface, both suppression of the amount of generated ozone and proper clinging of the medium to the clinging surface can be achieved.

According to a seventh aspect of the present disclosure, in the first aspect, the control unit determines a recording position of the medium in a transport direction on a surface adsorbed to the clinging surface as a state of the surface of the medium, and switches between the first charging unit and the second charging unit along the transport direction according to a recording position of the medium in the transport direction on the surface of the medium, which is in contact with the clinging surface.

According to an eighth aspect, in the first aspect, the control unit selects the charging of the clinging surface by the first charging unit in an intermediate area of the medium in the transport direction on the surface of the medium, which is in contact with the clinging surface, and selects the charging of the clinging surface by the second charging unit in an end portion area of the medium in the transport direction on the surface of the medium, which is in contact with the clinging surface.

According to the present aspect, since the control unit switches between the first charging unit and the second charging unit along the transport direction according to a recording position of the medium in the transport direction on the surface of the medium, which is in contact with the clinging surface, both suppression of the amount of generated ozone and proper clinging of the medium to the clinging surface can be achieved.

According to a ninth aspect, in any one of the first to sixth aspects, the first charging unit and the second charging unit charge the clinging surface to be positive polarity.

According to the present aspect, in a configuration in which the clinging surface is charged to be positive polarity, the operational effects of any one of the first to sixth aspects described above can be obtained.

According to a tenth aspect, in the first to seventh aspects, the recording apparatus further includes a charge removing brush that is configured to come into contact with the clinging surface, and a switching unit that switches whether or not the charge removing brush is grounded, in which the first charging unit is configured with the not-grounded charge removing brush.

According to the present aspect, since the charge removing brush, which is a configuration for removing charges, also serves as the first charging unit, an increase in costs can be suppressed by reducing the number of components.

Hereinafter, the present disclosure will be described in detail.

Hereinafter, an ink jet printer (hereinafter, referred to as a "printer") that performs ink jet recording on a recording paper sheet that is an example of a medium is described as an example of a recording apparatus according to the present disclosure. Further, in an ink jet method, the present disclosure may be applied even to any form such as a type in which an ink cartridge is mounted on a carriage and a type in which an ink containing portion is provided outside a carriage and the ink containing portion and the carriage are connected to each other using an ink tube. Further, a printer 1 according to the present embodiment is of a type in which an ink containing portion is provided outside a carriage and the ink containing portion and the carriage are connected to each other through an ink tube.

Further, a recording head that ejects an ink is of a type in which the recording head moves in a paper sheet width direction and a type in which the recording head is formed to have a size that covers the paper sheet width direction and does not move. The printer 1 according to the present embodiment corresponds to the latter type.

In an x-y-z coordinate system illustrated in each drawing, an x direction indicates a device depth direction and the paper sheet width direction, a y direction indicates a device width direction, and a z direction indicates a device height direction and a gravity direction. Further, a direction in which the recording paper sheet is transported is referred to as "downstream", and a direction that is opposite thereto is referred to as "upstream".

Hereinafter, the entire configuration of the printer 1 will be described with reference to FIGS. 1 and 2.

In FIG. 1, the printer 1 includes a scanner unit 3 on a main device body 2A that performs recording on the recording paper sheet, and includes extension units 2B and 2C under the main device body 2A. The main device body 2A includes a paper sheet cassette 10A, the extension unit 2B includes a paper sheet cassette 10B, and the extension unit 2C includes a paper sheet cassette 10C. These extension units 2B and 2C are optional units for increasing the number of sheets accommodated therein, and are optionally attached to the main device body 2A.

Reference numeral 5 denotes an operation unit that performs various operations of the printer 1, and reference numeral 4 denotes a tray for receiving the recording paper sheet to be discharged after recording, and more particularly, a face-down paper discharge tray for receiving the recording paper sheet discharged while a recording surface on which the recording is recently performed is directed to the lower side. Further, reference numeral 35 denotes a feeding unit, which can be opened and closed with respect to the main device body 2A as the feeding unit pivots about a not-illustrated pivoting point.

Reference numeral 6 denotes an opening and closing cover constituting the feeding unit 35, which can rotate about a rotary shaft 6*a* (see FIG. 2) and can be opened in a direction indicated by arrows e and f. In FIG. 1, an imaginary line and reference numeral 6-1 denote the opening and closing cover during opening and closing.

A manual feeding tray 41 (see FIG. 2) is provided inside the opening and closing cover 6. The manual feeding tray 41 rotates about a rotary shaft 41*a* and can be opened and closed together with the opening and closing cover 6. Further, the manual feeding tray 41 illustrated in FIG. 2 is in a storage posture, is opened in a clockwise direction from a state of FIG. 2, and enables manual paper feeding while being directed to the obliquely upper side.

Further, in the printer 1, a side on which the operation unit 5 is disposed is the front side of the apparatus, and a side on which the opening and closing cover 6 is provided is a right side surface of the apparatus. That is, in the printer 1, feeding, transporting, and discharging of the recording paper sheet are performed along a left-right direction of the apparatus.

Next, a paper sheet feeding path of the printer 1 will be described with reference to FIG. 2. The printer 1 has three feeding paths including a feeding path from the paper sheet cassette 10A (see a cassette feeding trajectory S1), a feeding path from the paper sheet cassettes 10B and 10C not illustrated in FIG. 2 (see an extension cassette feeding trajectory S2), and a feeding path from the manual feeding tray 41 on which the recording paper sheet is mounted (see a manual feeding path S3).

Further, the printer 1 has two paper sheet discharge methods including face-up discharge in which the recording surface on which the recording is recently performed is discharged while being directed to the upper side (see a face-up discharge trajectory T1) and face-down discharge in which the recording surface on which the recording is recently performed is discharged while being directed to the lower side (see a face-down discharge trajectory T2).

Figure 2:
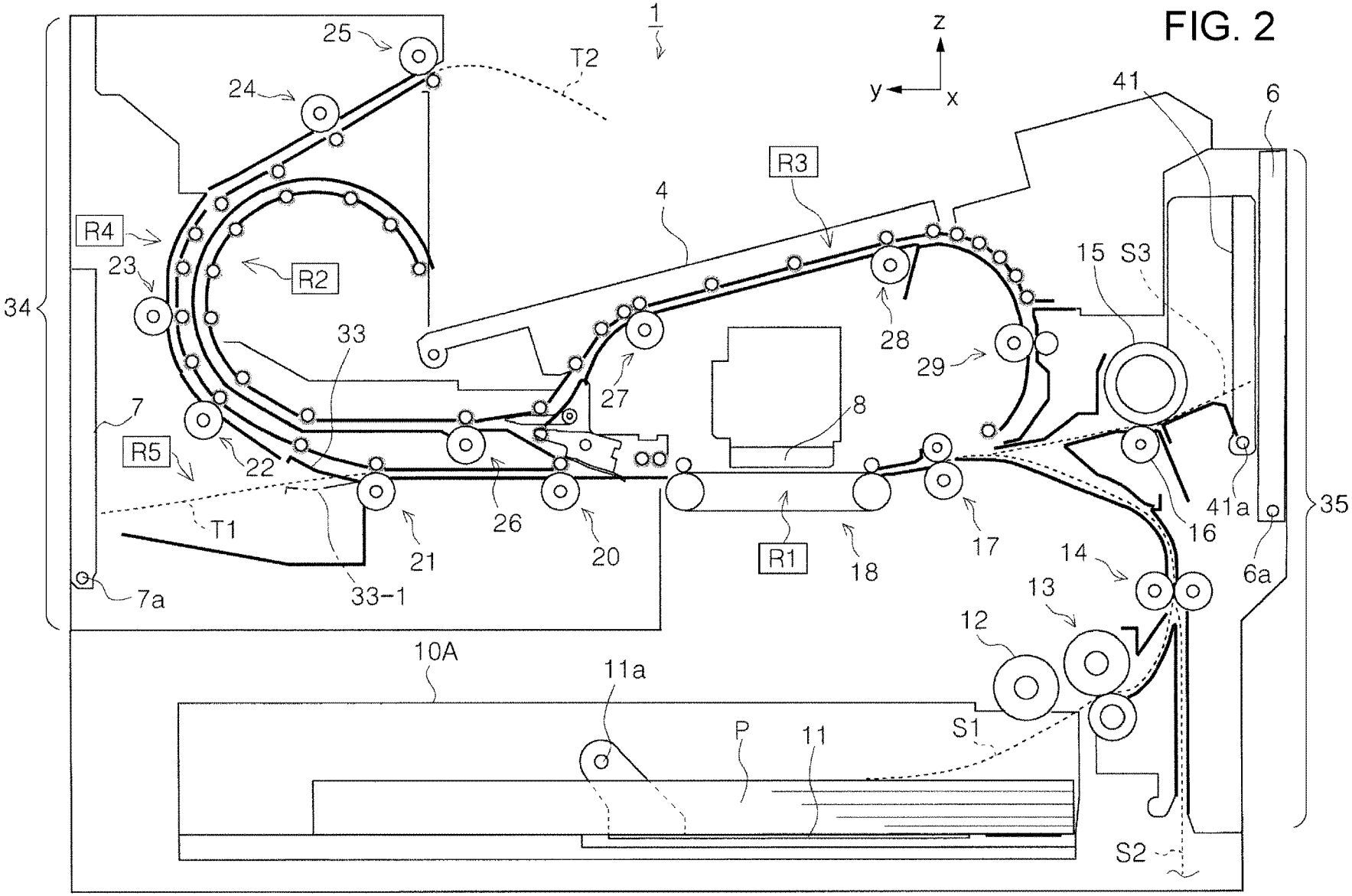
FIG. 2 is a side sectional view illustrating the entirety of a paper sheet transport path of the ink jet printer according to the present disclosure.

Further, in FIG. 2, reference numeral 7 denotes a face-up discharge tray for receiving a face-up-discharged recording paper sheet. As the face-up discharge tray 7 rotates about a rotary shaft 7*a*, a storage state illustrated in FIG. 2 and a not-illustrated open state are taken.

Thus, the printer 1 includes five paper sheet transport paths including a recording transport path R1, a switchback path R2, a reverse path R3, a face-down discharge path R4, and a face-up discharge path R5.

In FIG. 2, reference numeral 33 denotes a flap (a path switching member) driven by a not-illustrated driving source, which is switched between a state indicated by a solid line of FIG. 2 and reference numeral 33 and a state indicated by the imaginary line and reference numeral 33-1.

When the flap 33 is in the state indicated by a solid line of FIG. 2, the recording paper sheet is guided to the face-down discharge path R4, and is then face-down-discharged as indicated by the face-down discharge trajectory T2.

When the flap 33 is in the state of the imaginary line and reference numeral 33-1 of FIG. 2, the recording paper sheet is guided to the face-up discharge path R5, and is then face-up-discharged as indicated by the face-up discharge trajectory T1.

Hereinafter, a paper sheet feeding path up to a resist roller pair 17 will be described with reference to FIG. 2.

The paper sheet cassette 10A detachably provided in the main device body 2A includes a hopper 11. As the hopper 11 swings about a shaft 11*a*, the recording paper sheet accommodated in the paper sheet cassette 10A is brought into contact with and separated from a feeding roller 12 rotationally driven by a not-illustrated motor.

The recording paper sheet sent from the paper sheet cassette 10A by the feeding roller 12 is separated (is prevented from being double-fed) by passing through a nipping position by a separation roller pair 13, and receives a sending force from the transport roller pair 14 to reach the resist roller pair 17. Similarly, the extension units 2B and 2C (FIG. 1) located below the main device body 2A also include the feeding rollers 12 and the separation roller pairs 13, and the recording paper sheet sent from each paper sheet cassette receives the sending force from the transport roller pair 14 illustrated in FIG. 2 to reach the resist roller pair 17.

Further, a feeding roller 15 and a separation roller 16 are provided in a paper sheet feeding path (the manual feeding path S3) from the manual feeding tray 41, and the recording paper sheet set on the manual feeding tray 41 reaches the resist roller pair 17 by rotation of these rollers.

Figure 3:
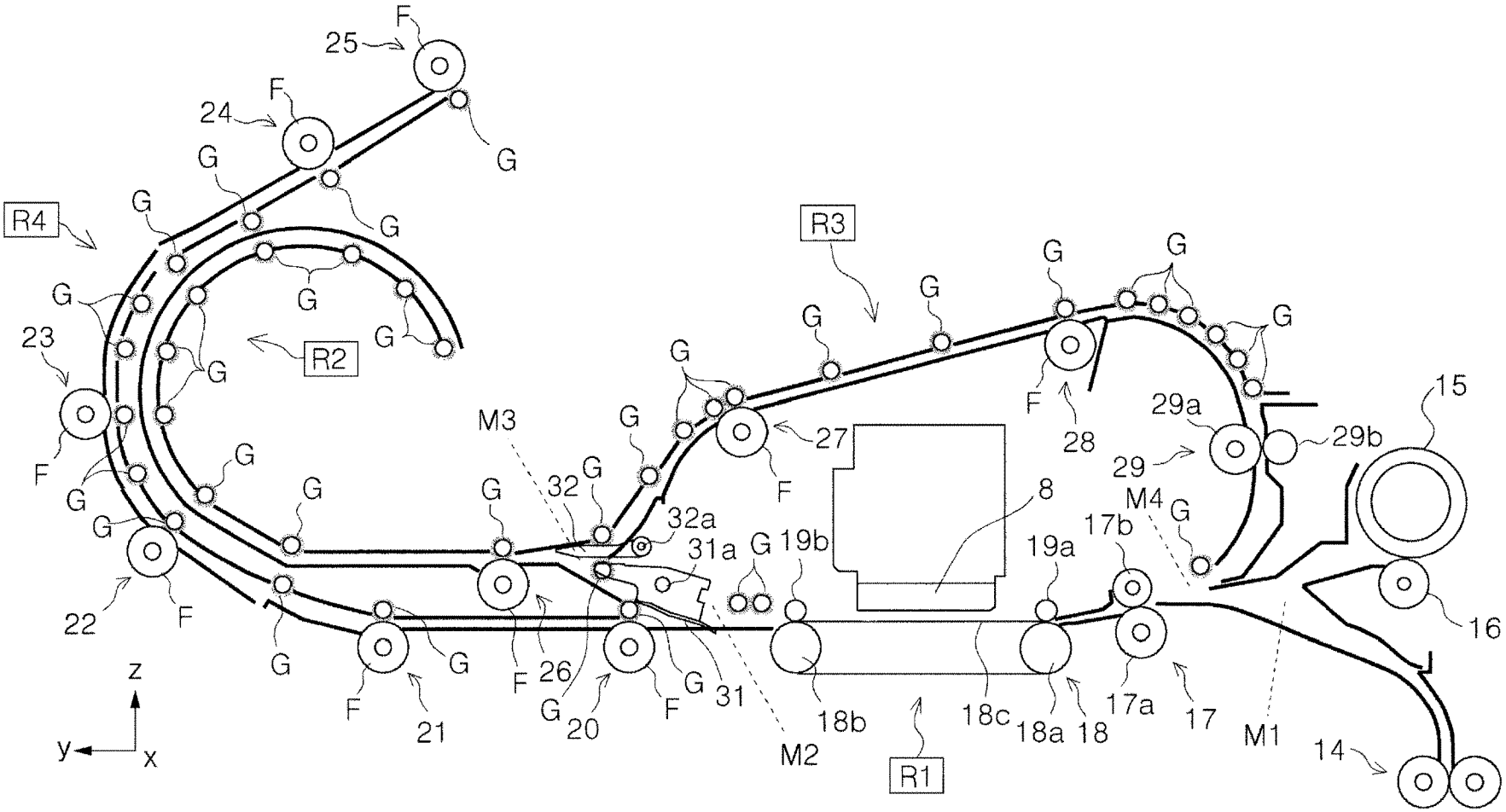
FIG. 3 is a side sectional view illustrating a partial area of the paper sheet transport path of the ink jet printer according to the present disclosure.

Hereinafter, a paper sheet transport path downstream of the resist roller pair 17 will be described with reference to FIG. 3. Further, in FIG. 3, it is assumed that the recording paper sheet is face-down-discharged through the face-down discharge path R4.

First, a roller provided in each paper sheet transport path will be described. In FIG. 3, reference numeral 17 denotes the resist roller pair, reference numerals 20 to 24 and 26 to 29 denote all transport roller pairs that transport the recording paper sheet, and reference numeral 25 denotes a discharge roller pair that discharges the recording paper sheet. In the roller pairs, symbol F denotes one roller of each roller pair other than the resist roller pair 17 and transport roller pair 29, and symbol G denotes the other roller. Further, the discharge roller pair 25 provided on the most downstream side of the face-down discharge path R4 constitutes a discharge unit for discharging the recording paper sheet from the face-down discharge path R4.

The rollers F are driving rollers driven by not-illustrated motors. For example, the rollers F are rubber rollers provided at appropriate intervals in the paper sheet width direction.

The rollers G, which are driven rollers that can nip the recording paper sheet between the rollers F by not-illustrated biasing means and perform driven rotation while coming into contact with the recording paper sheet, are provided in pair with the rollers F at appropriate intervals in the paper sheet width direction. The rollers G, which are incision rollers having a plurality of teeth on an outer circumference thereof, comes into point contact with the recording surface to suppress white spots or transfer of an ink on the already recorded surface.

Further, the driven rollers G are provided at appropriate positions on the paper sheet transport path in addition to constituting each transport roller pair, and are particularly provided on a side in contact with the nearest recording surface.

Meanwhile, configurations of the resist roller pair 17 and the transport roller pair 29 are different from the configurations of the above-described roller pairs. In detail, the transport roller pair 29 includes a driving roller 29*a* that performs rotation driving and a driven roller 29*b* pressed toward the driving roller 29*a* and capable of driven rotation. Among them, the driven roller 29*b* is a resin roller having a smooth outer circumferential surface.

The resist roller pair 17 includes a driving roller 17*a* that performs rotation driving and a driven roller 17*b* pressed toward the driving roller 17*a* by not-illustrated biasing means and capable of driven rotation. Among them, the driving roller 17*a* is a roller having fine unevennesses on an outer circumference thereof, and the driven roller 17*b* is a resin roller having a smooth outer circumferential surface.

Figure 4:
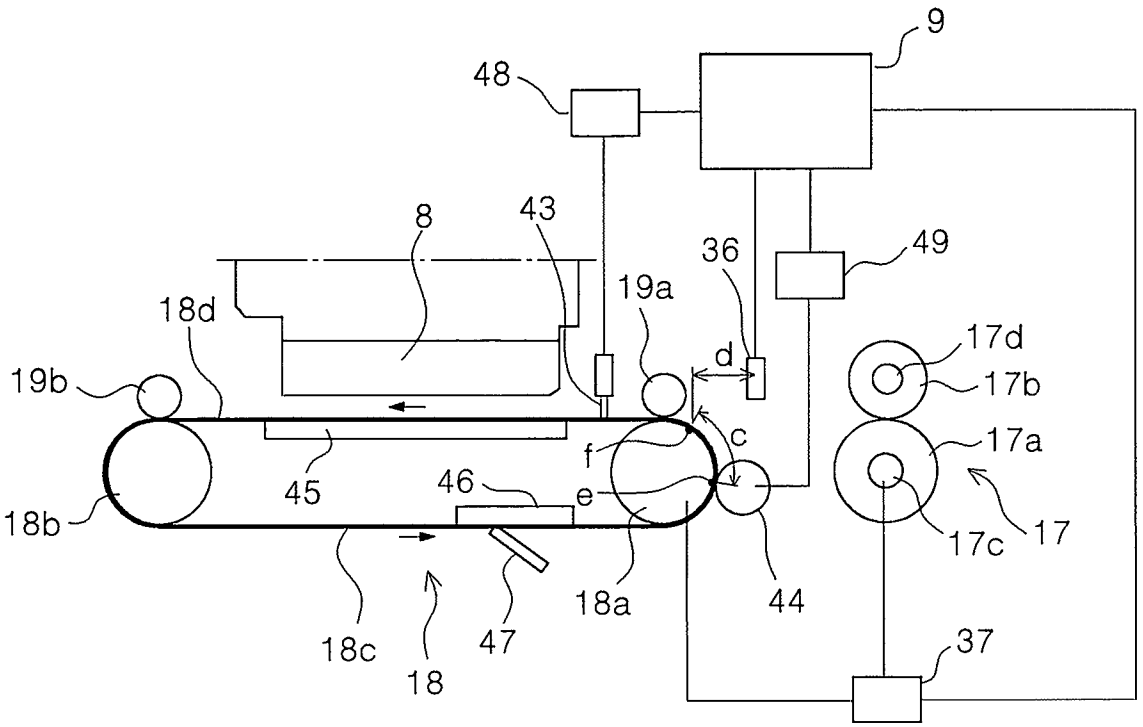
FIG. 4 is a side sectional view illustrating a partial area of the paper sheet transport path of the ink jet printer according to the present disclosure.

A plurality of the driving rollers 17*a* are provided at appropriate intervals along an axial direction with respect to a rotary shaft 17*c* (FIG. 4). Similarly, a plurality of the driven rollers 17*b* are provided at appropriate intervals along an axial direction with respect to a rotary shaft 17*d* (FIG. 4).

The recording paper sheet is guided between the above-described rollers by the following guide member. In FIGS. 2 to 4, in order to avoid complication of the drawing, no sign is attached to the guide member. However, a thick line connecting the rollers indicates the above-described guide member. Further, In FIG. 4 and subsequent figures, illustration of the guide member is omitted as appropriate.

Next, the recording transport path R1 as a first transport path passes through a lower side of a recording head 8 as a recording unit that performs the recording on the recording paper sheet, and extends to an upstream side and a downstream side thereof. In the present embodiment, for convenience, the recording transport path R1 approximately extends from a position M1 to a position M2 of FIG. 3. In the recording transport path R1, the paper sheet receives the sending force from the resist roller pair 17 and a belt unit 18.

In the present embodiment, the recording head 8 as recording means, which is a recording head (a so-called line head) provided as if a nozzle that ejects an ink covers the entire area in the paper sheet width direction, is configured as a recording head that can perform the recording on the entire paper sheet width without movement in the paper sheet width direction.

The switchback path R2 as a second transport path, which is a transport path connected to the recording transport path R1 and is a path that sends the recording paper sheet passing through the lower side of the recording head 8 (a left side of FIG. 3), switches back the recording paper sheet, and transports the recording paper sheet in an opposite direction to the sending direction (a right side of FIG. 3), is located inside a curvature with respect to the face-down discharge path R4, which will be described below. In the present embodiment, for convenience, the switchback path R2 is located approximately on the left side of a position M3 of FIG. 3. In the switchback path R2, the recording paper sheet receives the sending force from the transport roller pair 26.

The reverse path R3 as a third transport path, which is a transport path connected to the switchback path R2, reverses the recording paper sheet transported in the opposite direction (a right side of FIG. 3) by bypassing the upper side of the recording head 8, and is joined to an upstream position of the recording head 8 in the recording transport path R1 (in the present embodiment, an upstream position of the resist roller pair 17). In the present embodiment, for convenience, the reverse path R3 is set as a path approximately extending from a position M3 to a position M4 of FIG. 3. In the reverse path R3, the recording paper sheet receives the sending force from the transport roller pairs 27, 28, and 29.

The face-down discharge path R4 as a fourth transport path, which is a transport path connected to the recording transport path R1, is a path that reverses and discharges the recording paper sheet passing through a lower side of the recording head 8 by curving a surface facing the recording head 8. In the present embodiment, for convenience, the face-down discharge path R4 is located approximately on the left side of a position M2 of FIG. 3. In the face-down discharge path R4, the recording paper sheet receives the sending force from the transport roller pairs 20, 21, 22, 23, 24 and the discharge roller pair 25.

Further, a first flap 31 and a second flap 32 as a path switching member that switches the transport paths are provided at a connection portion between the transport paths. As the first flap 31 receives a driving force from not-illustrated driving means, the first flap 31 can swing about a swinging supporting point 31*a*. Further, the second flap 32 is provided to be engaged with the first flap 31 through a not-illustrated engagement portion, and swings about a swinging supporting point 32*a* according to swinging of the first flap 31.

With these flaps, a path along which the recording paper sheet is advanced is set.

Next, the belt unit 18 and a peripheral configuration thereof will be described with reference to FIG. 4. A transport belt 18*c* constituting the belt unit 18, which is an endless belt made of a base material made of urethane, rubber, or the like and containing a conductive material to adjust a resistance value as needed, is hung on and rotated by the upstream driving pulley 18*a* and the downstream driven pulley 18*b*, and a predetermined tension is applied to the transport belt 18*c* by a not-illustrated tensioner.

The driving pulley 18*a* is controlled by a controller 9 to perform rotation driving by a motor 37. When the driving pulley 18*a* performs rotation driving, the transport belt 18*c* operates, and the recording paper sheet adsorbed to the transport belt 18*c* is transported.

Support plates 45 and 46 are provided inside the transport belt 18*c*, and inward deflection of the transport belt 18*c* is regulated by the support plates 45 and 46. In the present embodiment, the support plates 45 and 46 are made of a conductive material such as metal and are grounded.

A charging roller 44 is provided at a position facing the driving pulley 18*a* with the transport belt 18*c* interposed therebetween. In the present embodiment, the printer 1 includes a first charging unit and a second charging unit as a unit for charging the transport belt 18*c*, and the charging roller 44 constitutes the second charging unit.

The charging roller 44 is in contact with an outer surface of the transport belt 18*c* to perform driven rotation according to an operation of the transport belt 18*c*. A power source unit 49 that applies a direct current (DC) voltage to the charging roller 44 is connected to the charging roller 44. Accordingly, the charging roller 44 supplies an electric charge from a portion in contact with the transport belt 18*c*. The power source unit 49 is controlled by the controller 9 to switch on and off application of a voltage to the charging roller 44 and to switch a voltage applied to the charging roller 44. Further, in the present embodiment, the charging roller 44 supplies a positive electric charge to the transport belt 18*c*, and charges an outer surface of the transport belt 18*c* to be positive polarity. That is, the outer surface of the transport belt 18*c* is set as an clinging surface 18*d* for suctioning the recording paper sheet.

The driven roller 19*a* is provided above the driving pulley 18*a* with the transport belt 18*c* interposed therebetween. Similarly, the driven roller 19*b* is provided above the driven roller 18*b* with the transport belt 18*c* interposed therebetween. The recording paper sheet transported by the transport belt 18*c* is pressed against the transport belt 18*c* by the driven rollers 19*a* and 19*b*.

Further, the driven rollers 19*a* and 19*b* are made of a conductive material such as metal, and are grounded.

A charge removing brush 43 that comes into contact with the recording paper sheet is provided upstream of the recording head 8, and electric charges on an upper surface of the recording paper sheet and an outer surface of the transport belt 18*c*, that is, an clinging surface 18*d*, are removed by the charge removing brush 43.

In more detail, when electric charges are applied to the clinging surface 18*d* of the transport belt 18*c* by the charging roller 44, charges having polarity opposite to polarity of a surface in contact with the clinging surface 18*d* are generated on the recording paper sheet in contact with the clinging surface 18*d*. Further, charges having polarity opposite to the charges are generated on an opposite surface of the recording paper sheet, that is, the recording surface. Charges on the recording surface are removed by the charge removing brush 43. Accordingly, only charges on a side in contact with the transport belt 18*c* remain on the recording paper sheet. As a result, the recording paper sheet is adsorbed to the clinging surface 18*d*.

The charge removing brush 43 may be made of any material as long as the material can remove charges from the recording paper sheet and the transport belt 18*c* and may be made of a resin material such as a conductive nylon.

Further, the charge removing brush 43 is used to remove charges of the transport belt 18*c*. The charge removing brush 43 is connected to a switching unit 48 as a switching unit, and the charge removing brush 43 switches between a state in which the charge removing brush 43 is grounded and a state in which the charge removing brush 43 is not grounded, under a control of the controller 9.

A cleaning blade 47 is provided below the belt unit 18. The cleaning blade 47 is provided as if the transport belt 18*c* is sandwiched between the support plate 46 and the cleaning blade 47. Ink and foreign matters adhering to the clinging surface 18*d* are removed by wiping the clinging surface 18*d* of the transport belt 18*c*. The cleaning blade 47 can be formed of a resin material such as a polyethylene terephthalate (PET) film or the like. Further, the cleaning blade 47 can be also provided to be switched between a state in which the cleaning blade 47 is connected to the transport belt 18*c* and a state in which the cleaning blade 47 is separated from the transport belt 18*c*.

Further, similarly to the above-described charge removing brush 43, as the cleaning blade 47 is connected to a switching unit for switching between a state in which the cleaning blade 47 is grounded and a state in which the cleaning blade 47 is not grounded, the cleaning blade 47 may be used as the first charging unit, which will be described below, in addition to the charge removing brush 43 or instead of the charge removing brush 43.

The above-described motor 37, the power supply unit 49, and the switching unit 48 are connected to the controller 9 as a control unit. The controller 9 acquires recording data that is data for performing recording, generated by a printer driver operated by a not-illustrated external computer or a printer driver included in the controller 9, and controls respective mechanisms including the recording head 8 or motors for transporting the recording paper sheet, based on the recording data. Further, the controller 9 performs necessary control based on the detection state of various sensors.

A sensor 36 illustrated in FIG. 4 is provided between the resist roller pair 17 and the belt unit 18 and sends a detection signal to the controller 9. Accordingly, the controller 9 can detect passage of a leading end and a trailing end of the recording paper sheet in a position of the sensor 36.

For example, the controller 9 can determine a timing when the clinging surface 18*d* starts to be charged by the charging roller 44 upon the detection of the passage of the leading end of the recording paper sheet in the position of the sensor 36, and can determine a timing when charging of the clinging surface 18*d* is terminated by the charging roller 44 upon the detection of the passage of the trailing end of the recording paper sheet.

Further, in the present embodiment, the resist roller pair 17 or the driving pulley 18*a* uses the motor 37 as a common driving source. A paper sheet transport speed by the resist roller pair 17 and a paper sheet transport speed by the belt unit 18 are determined based on a speed reduction ratio of a gear group that transmits power from the motor 37 to the resist roller pair 17 and the driving pulley 18*a*.

However, the resist roller pair 17 and the driving pulley 18*a* may be driven using separate motors, respectively.

Next, switching of the charging units will be described with reference to FIGS. 4 to 6. The above-described printer 1 includes the first charging unit and the second charging unit as a unit for charging the clinging surface 18*d* of the transport belt 18*c*. The first charging unit is a unit for frictionally charging the clinging surface 18*d*, and the second charging unit is a unit for charging the clinging surface 18*d* by applying a voltage to the transport belt 18*c*. Thus, the controller 9 switches between charging of the clinging surface 18*d* by the first charging unit and charging of the clinging surface 18*d* by the second charging unit, according to a state of a surface of the recording paper sheet in contact with the transport belt 18*c*. Hereinafter, the charging of the clinging surface 18*d* by the first charging unit may be called frictional charging, and the charging of the clinging surface 18*d* by the second charging unit may be called voltage application charging.

In the present embodiment, the second charging unit is configured with the charging roller 44 as described above, and charges the clinging surface 18*d* to be positive polarity by the charging roller 44. In the present embodiment, the first charging unit is configured with the charge removing brush 43, and charges the clinging surface 18*d* to be positive polarity by the charge removing brush 43.

The switching unit 48 connected to the charge removing brush 43 can be switched between a state in which the charge removing brush 43 is grounded and a state in which the charge removing brush 43 is not grounded, under the control of the controller 9. In the state in which the charge removing brush 43 is not grounded, as the charge removing brush 43 comes into contact with the transport belt 18*c* in operation, the clinging surface 18*d* is frictionally charged. In order to positively charge the clinging surface 18*d*, the charge removing brush 43 may be made of a material on a minus side rather than a material forming the transport belt 18*c* on charge series representing ease of the charging.

As described above, since the charge removing brush 43, which is a configuration for removing charges, also serves as the first charging unit, an increase in costs can be suppressed by reducing the number of components.

Further, even in a state in which the switching unit 48 is in contact with the charge removing brush 43, when charges of the clinging surface 18*d* are not completely removed by the charge removing brush 43, and a certain amount of charges remains on the clinging surface 18*d*, the frictional charging may be performed in a state in which the switching unit 48 grounds the charge removing brush 43. Thus, a configuration can be also adopted in which the switching unit 48 is omitted.

Thus, as the frictional charging is selected, the controller 9 can adsorb the recording paper sheet to the clinging surface 18*d* while preventing occurrence of ozone due to a charging process by the voltage application charging. In other words, as use of the voltage application charging is suppressed to minimum, both suppression of an amount of generated ozone and proper clinging of the recording paper sheet to the clinging surface 18*d* can be performed.

Further, as the frictional charging is selected, power consumption of the printer 1 can be suppressed.

Thus, when the frictional charging is used, the voltage application charging is not used. In contrast, when the voltage application charging is used, the frictional charging is not used. However, when the voltage application charging is used, the frictional charging may be used together with it.

Hereinafter, description will be made in more detail with reference to FIG. 5. Before the leading end of the recording paper sheet reaches the transport belt 18*c*, the controller 9 determines whether or not a surface of the recording paper sheet, which is in contact with the clinging surface 18*d*, is a surface to which the ink is already ejected, that is, an already recorded surface (step S101), and when it is determined that the surface is an unrecorded surface to which the ink is not ejected (No in step S101), uses frictional charging (step S104).

Figure 6:
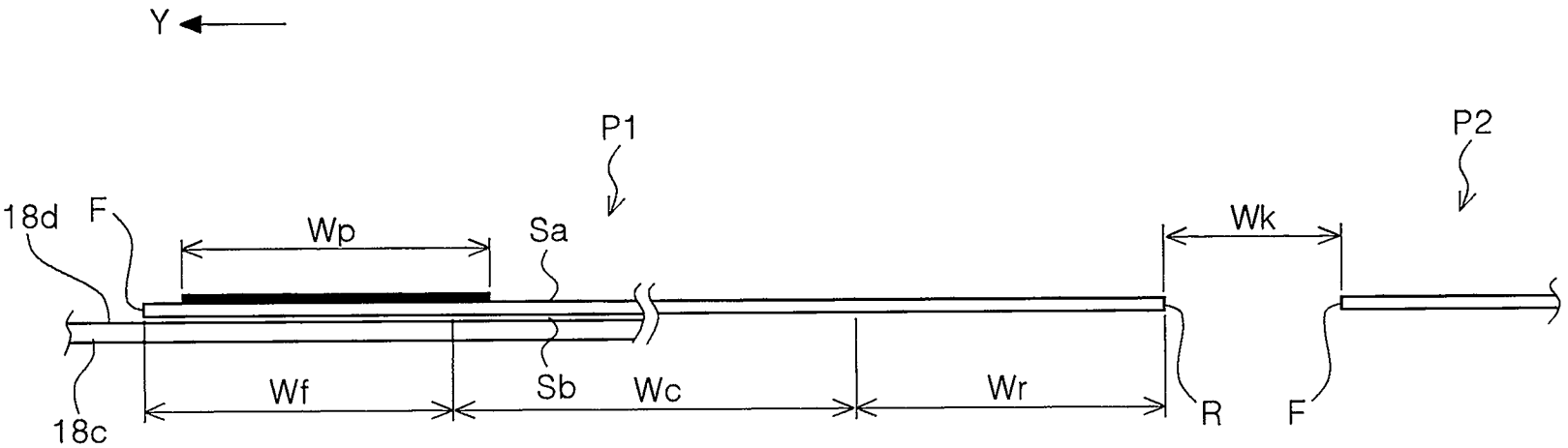
FIG. 6 is a diagram schematically illustrating an area of a recording sheet.

Here, as illustrated in FIG. 6, an unrecorded surface is a second surface Sb of the recording paper sheet, that is, a surface opposite to a first surface Sa that is a surface firstly facing the recording head 8 or is the first surface Sa when the recording is not performed on the first surface Sa and the recording paper sheet is reversed.

Referring back to FIG. 5, in step S101, in contrast, when a surface of the recording paper sheet, which is in contact with the clinging surface 18*d*, is an already recorded surface (Yes in step S101), whether or not a recording density is equal to or more than a predetermined threshold is determined (step S102), and when the recording density is less than the predetermined threshold (No in step S102), the frictional charging is used (step S104).

In contrast, when a recording density is equal to or more than a predetermined threshold (Yes in step S102), the voltage application charging is used (step S103).

Thus, when there is a next recording operation (Yes in step S105), the process returns to step S101.

That is, in the already recorded surface to which the ink is ejected and the unrecorded surface to which the ink is not ejected, the latter has a lower electrical conductivity than electrical conductivity of the former, and thus is adsorbed to the clinging surface 18*d* well. Further, when the recording density is low, the already recorded surface is adsorbed to the clinging surface 18*d* well. Here, the recording density means an area of ink ejected per unit area.

In this way, the controller 9 selects the frictional charging when the unrecorded surface is adsorbed to the clinging surface 18*d* and selects the voltage application charging when the already recorded surface is adsorbed to the clinging surface 18*d*. Accordingly, both when the already recorded surface is adsorbed and when the unrecorded surface is adsorbed, the recording paper sheet can be adsorbed appropriately. Further, even in the already recorded surface, since the frictional charging and the voltage application charging are switched according to the recording density, both the suppression of the amount of generated ozone and the proper clinging of the recording paper sheet to the clinging surface 18*d* can be achieved by the voltage application charging.

Further, a process based on the determination in step S102, that is, a process of switching between the frictional charging and the voltage application charging according to the recording density, is omitted. Regardless of the recording density, in the case of the already recorded surface, the voltage application charging may be selected always.

The above-described control example can be further described as follows.

(1) The charging of the clinging surface 18*d* by the voltage application charging is switched between charging by application of a first voltage and charging by application of a second voltage that is less than the first voltage. When the controller 9 selects the voltage application charging, in a contact area of the clinging surface 18*d*, which is in contact with the recording paper sheet, the first voltage may be selected, and in a non-contact area of the clinging surface 18*d*, which is not in contact with the recording paper sheet, the second voltage may be selected. Accordingly, the amount of generated ozone when the voltage application charging is selected can be suppressed.

The non-contact area of the clinging surface 18*d*, which is not in contact with the recording paper sheet, is an area between the preceding recording paper sheet and the following recording paper sheet as an example.

In FIG. 6, reference numeral P1 denotes the preceding paper sheet, and reference numeral P2 denotes the following paper sheet. The range of the clinging surface 18*d*, which corresponds to an area Wk between a trailing end R of the preceding paper sheet P1 and a leading end F of the following paper sheet P2, is an example of the non-contact area of the clinging surface 18*d*, which is not in contact with the recording paper sheet.

Further, the non-contact area of the clinging surface 18*d*, which is not in contact with the recording paper sheet, may be the entire clinging surface 18*d* before start of a recording job or the entire clinging surface 18*d* after termination of the recording job.

Further, the second voltage includes 0 V.

Figure 8:
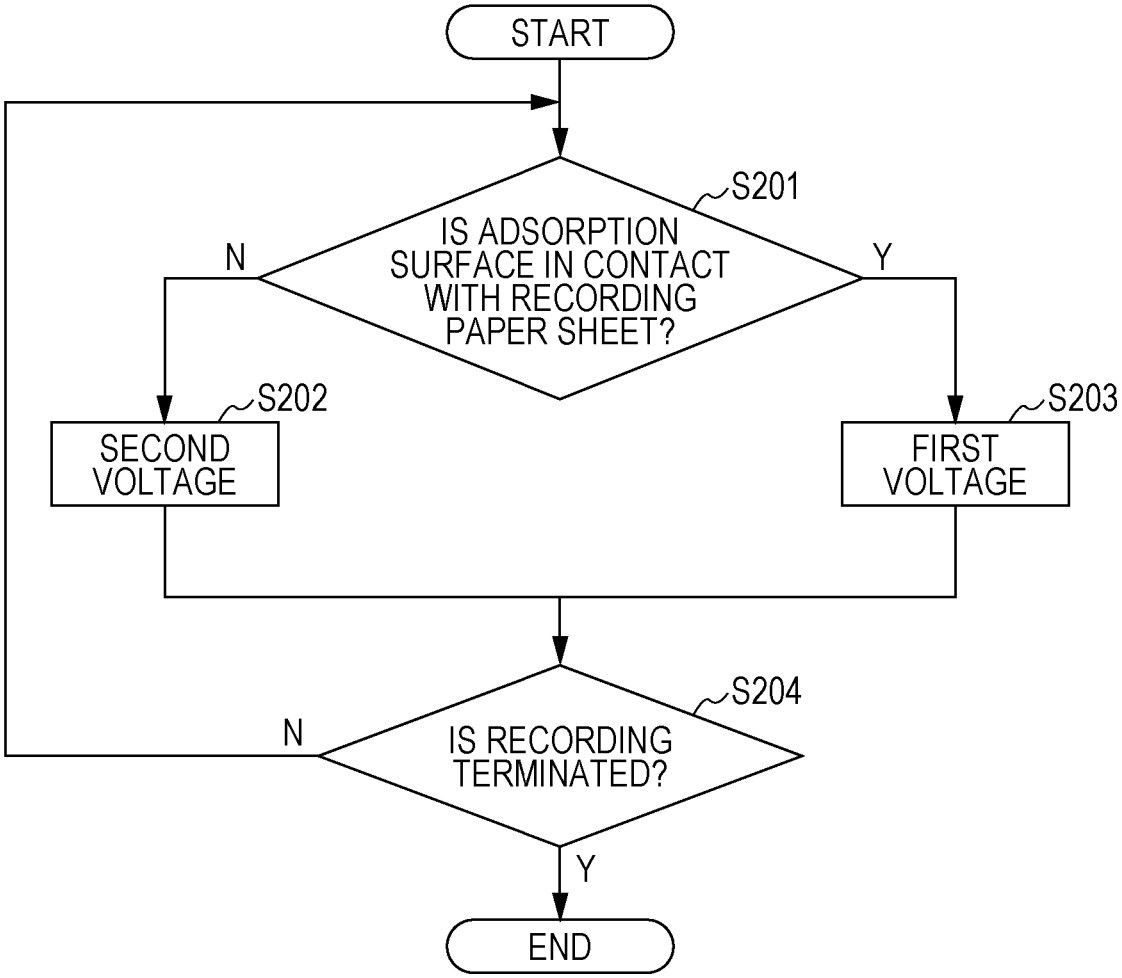
FIG. 8 is a flowchart illustrating an example of recording control of the ink jet printer according to the present disclosure.

FIG. 8 is a flowchart illustrating an example of the above control. The controller 9 selects the first voltage (step S203) when the clinging surface 18*d* is in contact with the recording paper sheet (Yes in step S201), and selects the second voltage that is lower than the first voltage (step S202) when the clinging surface 18*d* is not in contact with the recording paper sheet (No in step S201). The above-described process is repeated until the recording is terminated (step S204).

Figure 5:
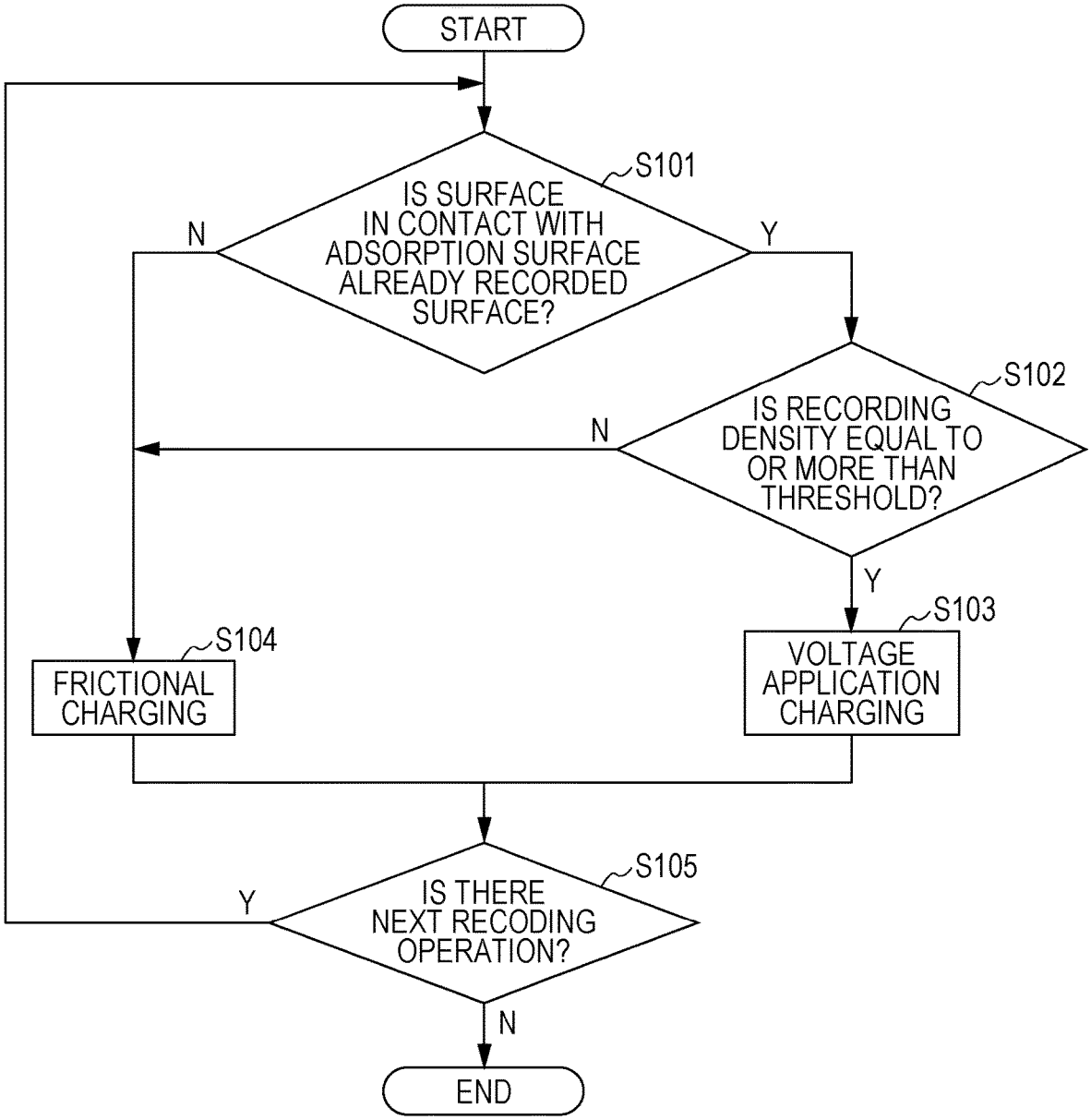
FIG. 5 is a flowchart illustrating an example of recording control of the ink jet printer according to the present disclosure.

Further, this control can be applied to the voltage application charging in step S103 in the control illustrated in FIG. 5.

(2) When the voltage application charging is selected, the controller 9 may select the first voltage in the area of the clinging surface 18*d* illustrated in FIG. 6 where a leading end Wf and a trailing end Wr of the recording paper sheet are in contact with each other, and the second voltage may be selected in an intermediate portion We between the leading end Wf and the trailing end Wr of the recording paper sheet.

Accordingly, floating from the clinging surface 18*d* can be satisfactorily suppressed by selecting the first voltage at the leading end Wf and the trailing end Wr of the recording paper sheet. Thus, occurrence of ozone can be suppressed by selecting the second voltage in the intermediate portion We between the leading end Wf and the trailing end Wr.

Further, even in the present embodiment, the second voltage includes 0 V.

Figure 9:
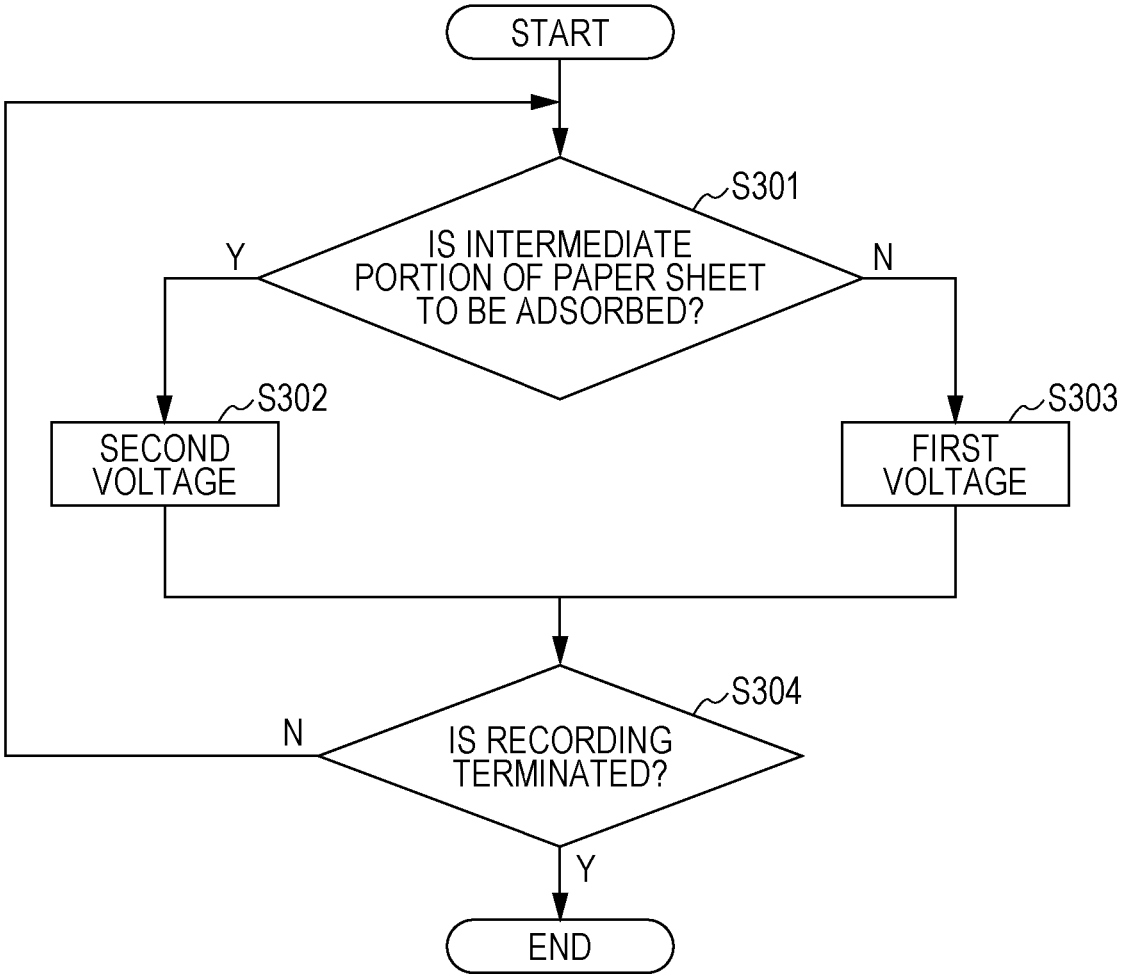
FIG. 9 is a flowchart illustrating an example of recording control of the ink jet printer according to the present disclosure.

FIG. 9 is a flowchart illustrating an example of the above control. The controller 9 selects the first voltage (step S303) in the case of not the intermediate portion of the paper sheet to be adsorbed (No in step S301), and selects the second voltage that is lower than the first voltage (step S302) in the case of the intermediate portion of the paper sheet to be adsorbed (Yes in step S301). The above-described process is repeated until the recording is terminated (step S304).

Further, this control can be applied to the voltage application charging in step S103 in the control illustrated in FIG. 5. At this time, the control illustrated in FIG. 8 can be further applied.

(3) The controller 9 switches between the frictional charging and the voltage application charging of a surface of the recording paper sheet, which is in contact with the clinging surface 18*d*, along the transport direction Y, according to a recording position of the recording paper sheet in the transport direction Y.

Figure 7:
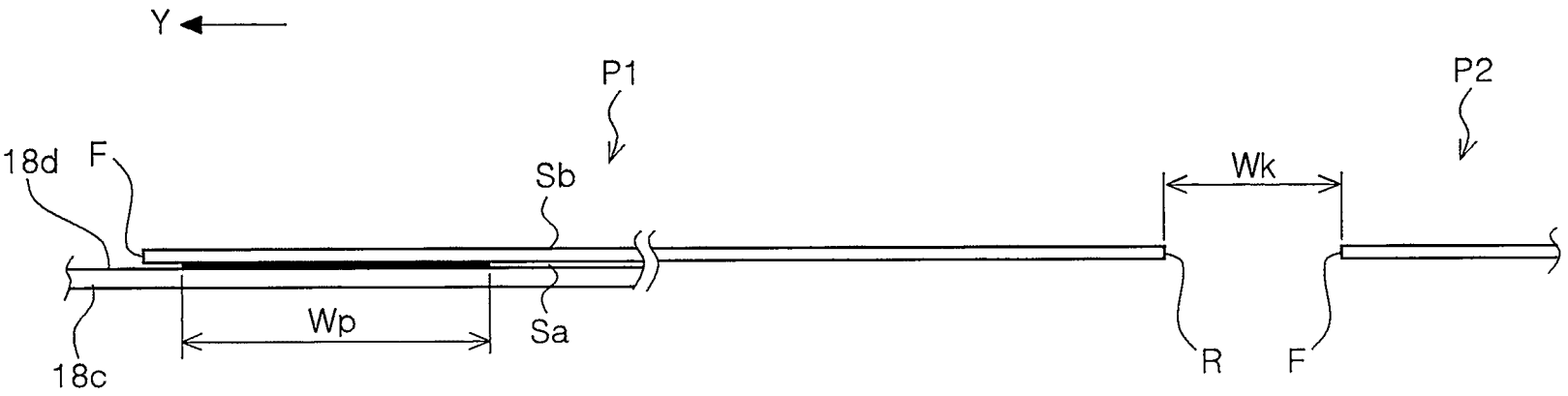
FIG. 7 is a diagram schematically illustrating an area of a recording sheet.

For example, in FIG. 6, it is assumed that the ink is ejected to an area Wp in the first surface Sa that is one surface of the recording paper sheet P1. Further, when the recording paper sheet P1 is reversed, and the area Wp comes into contact with the clinging surface 18*d* as illustrated in FIG. 7, the first voltage is selected in the area of the clinging surface 18*d*, which is in contact with the area Wp, and the second voltage is selected in an area where the other area except for the area Wp is in contact with the first surface Sa.

Accordingly, both the suppression of an amount of generated ozone and the proper clinging of the recording paper sheet to the clinging surface 18*d* can be performed.

Figure 10:
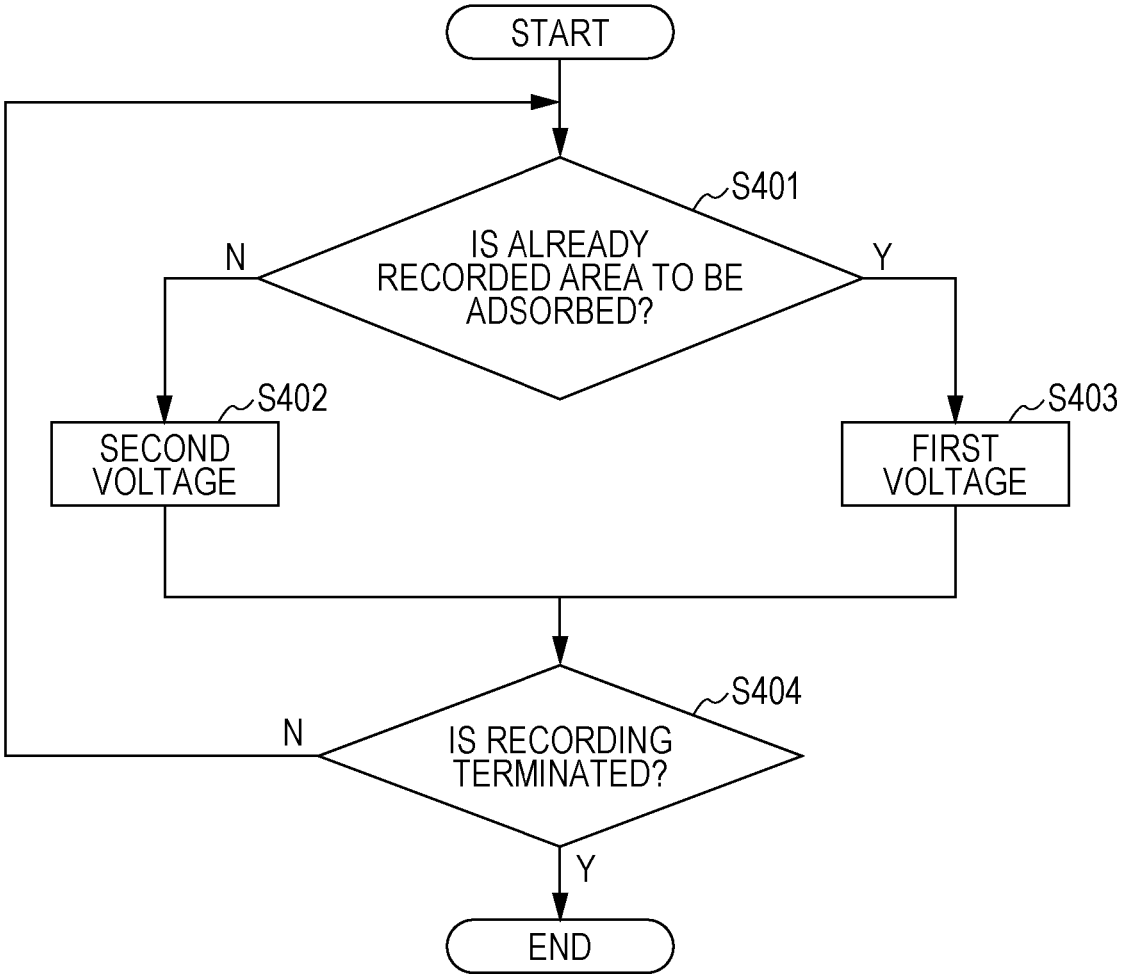
FIG. 10 is a flowchart illustrating an example of recording control of the ink jet printer according to the present disclosure.

FIG. 10 is a flowchart illustrating an example of the above control. The controller 9 selects the first voltage (step S403) in the case of an already recorded area to be adsorbed (Yes in step S401), and selects the second voltage that is less than the first voltage (step S402) in the case of an unrecorded area to be adsorbed (No in step S401). The above-described process is repeated until the recording is terminated (step S404).

Further, this control can be applied to the voltage application charging in step S103 in the control illustrated in FIG. 5. At this time, the control illustrated in FIG. 8 can be further applied.

Further, in FIG. 4, the charge removing brush 43 and the charging roller 44 may be disposed upstream of a contact start position f of the recording paper sheet in a rotation direction of the transport belt 18*c*. Among them, particularly, a distance c between a position e where the charging roller 44 close to the contact start position f is in contact with the transport belt 18*c* to the contact start position f may be longer than a distance d from a detection position of the sensor 36 in the paper sheet transport path to the contact start position f.

That is, when the distance c is shorter than the distance d, at a time point when a leading end of a paper sheet reaches the contact start position f, there is a possibility that the clinging surface 18*d* of the transport belt 18*c* is not charged. However, in the present embodiment, since the distance c is longer than the distance d, at a time point when the leading end of the paper sheet reaches the contact start position f, the clinging surface 18*d* is certainly charged.

In particular, this is suitable when the paper sheet transport speed by the resist roller pair 17 is equal to the paper sheet transport speed by the transport belt 18*c*.

The present disclosure is not limited to the above-described embodiments. However, it is apparent that various modifications can be made without departing from the scope of the present disclosure described in the appended claims, and are included in the scope of the present disclosure.

What is claimed is:

1. A recording apparatus comprising:

a recording head that performs recording on a medium;

a transport belt that has a clinging surface that clings the medium, and transports the medium to a position facing the recording head;

a first charging unit that is in contact with the transport belt to frictionally charge the clinging surface;

a second charging unit that applies a voltage to the transport belt to charge the clinging surface; and a control unit that switches between charging of the clinging surface by the first charging unit and charging of the clinging surface by the second charging unit, wherein the control unit switches between the charging of the clinging surface by the first charging unit and the charging of the clinging surface by the second charging unit, according to a state of a surface of the medium, which is in contact with the clinging surface, wherein the charging of the clinging surface by the second charging unit is configured to be switched between charging by application of a first voltage and charging by application of a second voltage that is less than the first voltage, and wherein when the charging of the clinging surface by the second charging unit is selected, the control unit selects the first voltage in a contact area of the clinging surface, which is in contact with the medium, and selects the second voltage in a non-contact area of the clinging surface, which is not in contact with the medium.

2. The recording apparatus according to claim 1, wherein the control unit determines a recording position of the medium in a transport direction on a surface adsorbed to the clinging surface as a state of a surface of the medium, and switches between the first charging unit and the second charging unit along the transport direction according to the recording position of the medium in the transport direction on the surface of the medium, which is in contact with the clinging surface.

3. The recording apparatus according to claim 2, wherein the control unit selects the charging of the clinging surface by the first charging unit in an intermediate area of the medium in the transport direction on the surface of the medium, which is in contact with the clinging surface, and selects the charging of the clinging surface by the second charging unit in an end portion area of the medium in the transport direction on the surface of the medium, which is in contact with the clinging surface.

4. The recording apparatus according to claim 1, wherein the first charging unit and the second charging unit charge the clinging surface to be positive polarity.

5. The recording apparatus according to claim 1, further comprising:

a charge removing brush that is configured to come into contact with the clinging surface; and a switching unit that switches whether or not the charge removing brush is grounded, wherein the first charging unit is configured with the not-grounded charge removing brush.

6. The recording apparatus according to claim 1, wherein the control unit determines a recording density of a surface adsorbed to the clinging surface as a state of the surface of the medium and selects the charging of the clinging surface by the first charging unit when the recording density of the surface of the medium, which is in contact with the clinging surface, is low, and selects the charging of the clinging surface by the second charging unit when the recording density of the surface of the medium, which is in contact with the clinging surface, is high.

7. A recording apparatus, comprising:

a recording head that performs recording on a medium;

a transport belt that has a clinging surface that clings the medium, and transports the medium to a position facing the recording head;

a first charging unit that is in contact with the transport belt to frictionally charge the clinging surface;

a second charging unit that applies a voltage to the transport belt to charge the clinging surface; and a control unit that switches between charging of the clinging surface by the first charging unit and charging of the clinging surface by the second charging unit, wherein the control unit switches between the charging of the clinging surface by the first charging unit and the charging of the clinging surface by the second charging unit, according to a state of a surface of the medium, which is in contact with the clinging surface, wherein the control unit determines whether or not recording is performed on a surface adsorbed to the clinging surface as a state of the surface of the medium, wherein when the surface of the medium on which the recording is not performed is adsorbed to the clinging surface, the control unit selects the charging of the clinging surface by the first charging unit, and wherein when the surface of the medium on which the recording is already performed is adsorbed to the clinging surface, the control unit selects the charging of the clinging surface by the second charging unit.

8. The recording apparatus according to claim 7, wherein the charging of the clinging surface by the second charging unit is configured to be switched between charging by application of a first voltage and charging by application of a second voltage that is less than the first voltage, and when the charging of the clinging surface by the second charging unit is selected, the control unit selects the first voltage in an area of the clinging surface, where a leading end and a trailing end of the medium are in contact with each other and selects the second voltage in an area of the clinging surface, which is in contact with an intermediate portion between the leading end and the trailing end of the medium.

9. The recording apparatus according to claim 7, wherein the control unit determines a recording position of the medium in a transport direction on a surface adsorbed to the clinging surface as a state of a surface of the medium, and switches between the first charging unit and the second charging unit along the transport direction according to the recording position of the medium in the transport direction on the surface of the medium, which is in contact with the clinging surface.

10. The recording apparatus according to claim 9, wherein the control unit selects the charging of the clinging surface by the first charging unit in an intermediate area of the medium in the transport direction on the surface of the medium, which is in contact with the clinging surface, and selects the charging of the clinging surface by the second charging unit in an end portion area of the medium in the transport direction on the surface of the medium, which is in contact with the clinging surface.

11. The recording apparatus according to claim 7, wherein the first charging unit and the second charging unit charge the clinging surface to be positive polarity.

12. The recording apparatus according to claim 7, further comprising:

a charge removing brush that is configured to come into contact with the clinging surface; and a switching unit that switches whether or not the charge removing brush is grounded, wherein the first charging unit is configured with the not-grounded charge removing brush.

13. The recording apparatus according to claim 7, wherein the charging of the clinging surface by the second charging unit is configured to be switched between charging by application of a first voltage and charging by application of a second voltage that is less than the first voltage, and when the charging of the clinging surface by the second charging unit is selected, the control unit selects the first voltage in a contact area of the clinging surface, which is in contact with the medium, and selects the second voltage in a non-contact area of the clinging surface, which is not in contact with the medium.

14. The recording apparatus according to claim 7, wherein the control unit determines a recording density of a surface adsorbed to the clinging surface as a state of the surface of the medium and selects the charging of the clinging surface by the first charging unit when the recording density of the surface of the medium, which is in contact with the clinging surface, is low, and selects the charging of the clinging surface by the second charging unit when the recording density of the surface of the medium, which is in contact with the clinging surface, is high.

15. A recording apparatus, comprising:

a recording head that performs recording on a medium;

a transport belt that has a clinging surface that clings the medium, and transports the medium to a position facing the recording head;

a first charging unit that is in contact with the transport belt to frictionally charge the clinging surface;

a second charging unit that applies a voltage to the transport belt to charge the clinging surface; and a control unit that switches between charging of the clinging surface by the first charging unit and charging of the clinging surface by the second charging unit, wherein the control unit switches between the charging of the clinging surface by the first charging unit and the charging of the clinging surface by the second charging unit, according to a state of a surface of the medium, which is in contact with the clinging surface, and wherein the control unit determines a recording density of a surface adsorbed to the clinging surface as a state of the surface of the medium, and switches between the first charging unit and the second charging unit according to the recording density of the surface of the medium, which is in contact with the clinging surface.

16. The recording apparatus according to claim 15, wherein the control unit selects the charging of the clinging surface by the first charging unit when the recording density of the surface of the medium, which is in contact with the clinging surface, is low, and selects the charging of the clinging surface by the second charging unit when the recording density of the surface of the medium, which is in contact with the clinging surface, is high.

17. The recording apparatus according to claim 15, wherein the control unit determines a recording position of the medium in a transport direction on a surface adsorbed to the clinging surface as a state of a surface of the medium, and switches between the first charging unit and the second charging unit along the transport direction according to the recording position of the medium in the transport direction on the surface of the medium, which is in contact with the clinging surface.

18. The recording apparatus according to claim 17, wherein the control unit selects the charging of the clinging surface by the first charging unit in an intermediate area of the medium in the transport direction on the surface of the medium, which is in contact with the clinging surface, and selects the charging of the clinging surface by the second charging unit in an end portion area of the medium in the transport direction on the surface of the medium, which is in contact with the clinging surface.

19. The recording apparatus according to claim 15, wherein the first charging unit and the second charging unit charge the clinging surface to be positive polarity.

20. The recording apparatus according to claim 15, further comprising:

a charge removing brush that is configured to come into contact with the clinging surface; and a switching unit that switches whether or not the charge removing brush is grounded, wherein the first charging unit is configured with the not-grounded charge removing brush.

* * * * *